US011395507B2

(12) United States Patent
Williams et al.

(10) Patent No.: US 11,395,507 B2
(45) Date of Patent: Jul. 26, 2022

(54) FILTER FOR AN E-VAPING DEVICE, E-VAPING DEVICE WITH THE FILTER, AND METHOD OF FORMING THE FILTER

(71) Applicant: Altria Client Services LLC, Richmond, VA (US)

(72) Inventors: Dwight David Williams, Richmond, VA (US); Rebecca Secrist, Petersburg, VA (US); Danielle Crawford, Chester, VA (US); Terry Bache, Richmond, VA (US); Eric Hawes, Glen Allen, VA (US); Maria Del Carmen Jarquin, Henrico, VA (US); Munmaya K. Mishra, Manakin Sabot, VA (US); Shaoyong Yu, Glen Allen, VA (US)

(73) Assignee: Altria Client Services LLC, Richmond, VA (US)

( * ) Notice: Subject to any disclaimer, the term of this patent is extended or adjusted under 35 U.S.C. 154(b) by 61 days.

(21) Appl. No.: 16/125,393

(22) Filed: Sep. 7, 2018

(65) Prior Publication Data

US 2020/0077696 A1 Mar. 12, 2020

(51) Int. Cl.

| | |
|---|---|
| ***A24D 3/04*** | (2006.01) |
| ***A24D 3/02*** | (2006.01) |
| ***A24D 3/06*** | (2006.01) |
| ***A24D 3/10*** | (2006.01) |

(52) U.S. Cl.

CPC ..... *A24D 3/048* (2013.01); *A24D 3/022* (2013.01); *A24D 3/0229* (2013.01); *A24D 3/062* (2013.01); *A24D 3/10* (2013.01)

(58) Field of Classification Search

None

See application file for complete search history.

(56) References Cited

U.S. PATENT DOCUMENTS

| | | | |
|---|---|---|---|
| 3,255,760 | A | 6/1966 | Selke et al. |
| 3,640,285 | A | 2/1972 | Briskin et al. |
| 4,210,158 | A | 7/1980 | Vinals et al. |
| 4,357,950 | A | 11/1982 | Berger |
| 4,649,944 | A | 3/1987 | Houck, Jr. et al. |
| 4,889,143 | A | 12/1989 | Pryor et al. |

(Continued)

FOREIGN PATENT DOCUMENTS

| | | | |
|---|---|---|---|
| GB | 1055473 | A | 1/1967 |
| WO | WO-2006/117697 | A1 | 11/2006 |

(Continued)

OTHER PUBLICATIONS

International Search Report and Written Opinion dated Nov. 27, 2019, issued in corresponding PCT Application No. PCT/EP2019/073881.

(Continued)

*Primary Examiner* — Phu H Nguyen

(74) *Attorney, Agent, or Firm* — Harness, Dickey & Pierce, P.L.C.

(57) ABSTRACT

The filter includes a contained filter material with one or more portions of a filter material. The one or more portions define interstices running through a longitudinal length of the contained filter material. The interstices allow an airflow to pass through the longitudinal length of the contained filter material. A consumable substance is infused within the filter material. The consumable substance includes nicotine, a flavorant, a pre-vapor formulation, a sub-combination thereof, or a combination thereof.

20 Claims, 12 Drawing Sheets

(56) References Cited

U.S. PATENT DOCUMENTS

| | | | |
|---|---|---|---|
| 4,903,714 | A | 2/1990 | Barnes et al. |
| 4,936,920 | A | 6/1990 | Keritsis et al. |
| 5,005,593 | A | 4/1991 | Fagg |
| 5,025,814 | A | 6/1991 | Raker |
| 5,074,320 | A | 12/1991 | Jones, Jr. et al. |
| 5,105,836 | A | 4/1992 | Gentry et al. |
| 5,129,409 | A | 7/1992 | White et al. |
| 5,203,355 | A | 4/1993 | Clearman et al. |
| 5,269,327 | A | 12/1993 | Counts et al. |
| 5,360,023 | A | 11/1994 | Blakley et al. |
| 5,396,911 | A | 3/1995 | Casey, III et al. |
| 5,505,214 | A | 4/1996 | Collins et al. |
| 5,829,453 | A | 11/1998 | White et al. |
| 5,863,652 | A | 1/1999 | Matsumura et al. |
| 6,289,897 | B1 | 9/2001 | McAdam et al. |
| 7,578,298 | B2 | 8/2009 | Karles et al. |
| 7,647,932 | B2 | 1/2010 | Cantrell et al. |
| 7,726,320 | B2 | 6/2010 | Robinson et al. |
| 8,113,215 | B2 | 2/2012 | Rasoull et al. |
| 8,157,918 | B2 | 4/2012 | Becker et al. |
| 8,186,360 | B2 | 5/2012 | Marshall et al. |
| 8,464,728 | B2 | 6/2013 | Sebastian et al. |
| 8,739,802 | B2 | 6/2014 | Fagg |
| 8,967,155 | B2 | 3/2015 | Bundren et al. |
| 9,004,073 | B2 | 4/2015 | Tucker et al. |
| 9,066,541 | B2 | 6/2015 | Allen et al. |
| 9,072,321 | B2 | 7/2015 | Liu |
| 9,220,301 | B2 | 12/2015 | Banerjee et al. |
| 9,402,422 | B2 | 8/2016 | Shenkal |
| 2005/0053665 | A1 | 3/2005 | Ek et al. |
| 2005/0263165 | A1 | 12/2005 | Oh et al. |
| 2007/0056600 | A1 | 3/2007 | Coleman et al. |
| 2010/0147317 | A1 | 6/2010 | Fallon |
| 2011/0036367 | A1 | 2/2011 | Saito et al. |
| 2011/0271971 | A1 | 11/2011 | Conner et al. |
| 2012/0067359 | A1 | 3/2012 | Clarke et al. |
| 2012/0125354 | A1 | 5/2012 | Byrd et al. |
| 2012/0001865 | A1 | 7/2012 | Liu |
| 2013/0192615 | A1 | 8/2013 | Tucker et al. |
| 2013/0192620 | A1 | 8/2013 | Tucker et al. |
| 2014/0166032 | A1 | 6/2014 | Gindrat |
| 2014/0261486 | A1 | 9/2014 | Potter |
| 2015/0000682 | A1 | 1/2015 | Liu |
| 2015/0027468 | A1 | 1/2015 | Li et al. |
| 2015/0027469 | A1 | 1/2015 | Tucker et al. |
| 2015/0305410 | A1 | 10/2015 | Liu |
| 2016/0106154 | A1 | 4/2016 | Lord |
| 2016/0120224 | A1 | 5/2016 | Mishra et al. |
| 2016/0135506 | A1 | 5/2016 | Sanchez et al. |
| 2016/0143348 | A1 | 5/2016 | Camus et al. |
| 2016/0208440 | A1 | 7/2016 | Byrd, Jr. et al. |
| 2016/0295909 | A1 | 10/2016 | Besso et al. |
| 2016/0295914 | A1 | 10/2016 | Jordit et al. |
| 2016/0295922 | A1 | 10/2016 | John et al. |
| 2016/0295926 | A1 | 10/2016 | Zuber |
| 2016/0302477 | A1 | 10/2016 | Besso |
| 2016/0324216 | A1 | 11/2016 | Li et al. |
| 2017/0064995 | A1 | 3/2017 | Beeson |
| 2017/0145634 | A1 | 5/2017 | Bradbury et al. |
| 2017/0251723 | A1 | 9/2017 | Kobal et al. |
| 2018/0007966 | A1 | 1/2018 | Li et al. |
| 2018/0146713 | A1 | 5/2018 | Robinson et al. |
| 2018/0177233 | A1 | 6/2018 | Tucker et al. |

FOREIGN PATENT DOCUMENTS

| | | | |
|---|---|---|---|
| WO | WO-2007053097 | A1 | 5/2007 |
| WO | WO-2014/180893 | A1 | 11/2014 |
| WO | WO-2017093358 | A1 | 6/2017 |

OTHER PUBLICATIONS

'Additives in Tobacco Products: Cellulose Fibre' German Cancer Research Center, Jan. 2012, https://www.dkfz.de/de/tabakkontrolle/download/PITOC/PITOC_Tobacco_Additives_Cellulose_Fibre.pdf.

International Search Report and Written Opinion dated Oct. 29, 2019. issued in corresponding PCT Applicatian No. PCT/US2019/045096.

International Search Report and Written Opinion dated Nov. 27, 2019, issued in corresponding PCT Application No. PCT/EP2019/073892.

Office Action dated Feb. 10, 2021, issued in co-pending U.S. Appl. No. 16/125,399.

Office Action dated Nov. 2, 2020, issued in co-pending U.S. Appl. No. 16/125,399.

International Preliminary Report on Patentability dated Sep. 29, 2020, issued in corresponding International Application No. PCT/EP2019/073881.

International Preliminary Report on Patentability dated Mar. 18, 2021, issued in corresponding International Application No. PCT/US2019/045096.

International Preliminary Reporton Patentability dated Mar. 18, 2021, issued in corresponding International Application No. PCT/EP2019/073892.

European Office Action dated Feb. 10, 2022, issued in corresponding European Patent Application No. 19 753 575.0.

Office Action dated Oct. 6, 2021, issued in corresponding U.S. Appl. No. 16/125,293.

Notice of Allowance dated Nov. 22, 2021, issued in corresponding U.S. Appl. No. 16/125,399.

Advisory Action dated Apr. 5, 2021, issued in co-pending U.S. Appl. No. 16/125,399.

Office Action dated May 19, 2021, issued in co-pending U.S. Appl. No. 16/125,399.

"Active Paper Filter", Essentra, www.essentra.com/en/industries/tobacco/filter-range/performance-range/performance-range/vapour-red . . . , Mar. 25, 2018.

Notice of Allowance dated May 3, 2022 issued in corresponding U.S. Appl. No. 16/125,293.

FILTER FOR AN E-VAPING DEVICE, E-VAPING DEVICE WITH THE FILTER, AND METHOD OF FORMING THE FILTER

BACKGROUND

Field

Example embodiments generally relate to a filter for an electronic vaping (e-vaping) device, an e-vaping device with the filter and a method of forming the filter.

Related Art

An e-vaping device uses a heater to at least partially volatilize a pre-vapor formulation to produce a vapor. The heating process does not involve combustion.

SUMMARY

At least one example embodiment is directed toward a filter for e-vaping.

In one embodiment, the filter includes a contained filter material including, one or more portions of a filter material, the one or more portions defining interstices running through a longitudinal length of the contained filter material, the interstices being configured to allow an airflow to pass through the longitudinal length of the contained filter material, and at least one first consumable substance infused within the filter material, the at least one first consumable substance including at least one of nicotine, at least one first flavorant, a pre-vapor formulation, a sub-combination thereof, or a combination thereof.

In one embodiment, the one or more portions includes at least one sheet of the filter material that is crimped.

In one embodiment, the one or more portions includes at least one sheet of the filter material that has a plurality of folds, the plurality of folds running through the longitudinal length of the contained filter material, the interstices being defined by the plurality of folds of the at least one sheet of the filter material.

In one embodiment, the contained filter material has a resistance-to-draw (RTD) of about 5 mm of water to 40 mm of water.

In one embodiment, the filter material is made from paper, wood pulp, or paper and the wood pulp.

In one embodiment, the at least one first consumable substance includes the at least one first flavorant, the at least one first flavorant being a tobacco extract.

In one embodiment, the at least one first consumable substance includes the at least one first flavorant, the at least one first flavorant being a non-tobacco flavorant.

In one embodiment, the at least one first consumable substance includes nicotine in a weight of between about 1 mg and 15 mg.

In one embodiment, the filter material includes one of a non-tobacco plant-based cellulose, a tobacco cellulose or both the non-tobacco plant-based cellulose and the tobacco cellulose.

In one embodiment, the filter further includes at least one first containing structure containing the one or more portions, the at least one first containing structure contacting at least side surfaces of the contained filter material, wherein the at least one first containing structure defines a first opening and a second opening on respective ends of the contained filter material.

In one embodiment, the filter further includes a flow restriction section with a first end and a second end, the first end of the flow restriction section being connected to the contained filter material; and a non-consumable filter connected to the second end of the flow restriction section, the non-consumable filter being devoid of a consumable substance.

In one embodiment, the filter further includes at least one first containing structure contacting at least side surfaces of the contained filter material, the flow restriction section and the non-consumable filter, to contain the contained filter material, the flow restriction section and the non-consumable filter together, and wherein the flow restriction section defines an internal void space with a flow restrictor in the internal void space, the flow restrictor being spaced apart from the first end and the second end of the flow restriction section.

In one embodiment, the filter further includes a reservoir containing the at least one first consumable substance, the reservoir being in fluid communication with the contained filter material.

In one embodiment, the filter further includes a reservoir configured to contain the at least one first consumable substance; and a structural transport, the structural transport being configured to maintain fluid communication between the reservoir and the contained filter material.

At least another example embodiment is directed toward a device.

In one embodiment, the device includes at least one first section including, an airflow passage, a first reservoir configured to contain at least a first pre-vapor formulation, a heater in communication with the first reservoir and the airflow passage, the heater being configured to at least partially vaporize the first pre-vapor formulation, and a filter in communication with the airflow passage, the filter being downstream of the heater, the filter including, a contained filter material including one or more portions of a filter material, the one or more portions defining interstices running through a longitudinal length of the contained filter material, the interstices being configured to allow an airflow to pass through the longitudinal length of the contained filter material, and at least one first consumable substance infused within the filter material, the at least one first consumable substance including at least one of nicotine, at least one first flavorant, a pre-vapor formulation, a sub-combination thereof, or a combination thereof.

In one embodiment, the device further includes a control system in electrical communication with the heater, the control system being configured to detect at least one first parameter, the at least one first parameter being at least one of a resistance of the heater, a temperature of the heater, a draw of air in the airflow passage, a combination thereof, or a sub-combination thereof, and the control system being configured to send an electrical current to the heater based on the at least one first parameter.

In one embodiment, the one or more portions includes at least one sheet of the filter material that has a plurality of folds, the plurality of folds running through the longitudinal length of the contained filter material, the interstices being defined by the plurality of folds of the at least one sheet of the filter material.

In one embodiment, the contained filter material has a resistance-to-draw (RTD) of about 5 mm of water to 40 mm of water.

In one embodiment, the at least one first consumable substance includes the at least one first flavorant, the at least one first flavorant being at least one of a tobacco extract, a non-tobacco flavorant or both the tobacco extract and the non-tobacco flavorant.

In one embodiment, the filter of the device further includes, a flow restriction section with a first end and a second end, the first end of the flow restriction section being connected to the contained filter material, the flow restriction section defining an internal void space with a flow restrictor in the internal void space, the flow restrictor being spaced apart from the first end and the second end of the flow restriction section, a non-consumable filter connected to the second end of the flow restriction section, the non-consumable filter being devoid of a consumable substance, and at least one first containing structure contacting at least side surfaces of the contained filter material, the flow restriction section and the non-consumable filter, to contain the contained filter material, the flow restriction section and the non-consumable filter together to form a rod, wherein the rod is configured to insert into a distal end of the at least one first section such that the non-consumable filter extends from the at least one first section.

At least another example embodiment is directed toward a method of forming a filter for an e-vaping section.

In one embodiment, the method includes forming a filter material sheet; containing the filter material sheet to form a contained filter material, the containing including, folding the filter material sheet to create a plurality of folds along a width of the filter material sheet, gathering the filter material sheet to form the contained filter material, the plurality of folds in the filter material sheet forming interstices running through a longitudinal length of the contained filter material, the interstices being configured to allow an airflow to pass through the longitudinal length of the contained filter material; and infusing the filter material sheet with at least one first consumable substance, the at least one first consumable substance being one of nicotine, at least one first flavorant, a pre-vapor formulation, a combination thereof, or a sub-combination thereof.

In one embodiment, the containing of the filter material sheet includes ensuring that the contained filter material has a resistance-to-draw (RTD) of about 5 mm of water to 40 mm of water.

In one embodiment, the infusing of the filter material sheet includes infusing the filter material sheet with the at least one first flavorant, the at least one first flavorant being at least one of a tobacco extract, a non-tobacco flavorant, or both the tobacco extract and the non-tobacco flavorant.

In one embodiment, the method further includes connecting a first end of a flow restriction section to the contained filter material; connecting a second end of the flow restriction section to a non-consumable filter, the non-consumable filter being devoid of a consumable substance, the flow restriction section defining an internal void space with a flow restrictor in the internal void space, the flow restrictor being spaced apart from the first end and the second end of the flow restriction section; and containing the contained filter material, the flow restriction section and the non-consumable filter together using at least one first containing structure.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1:
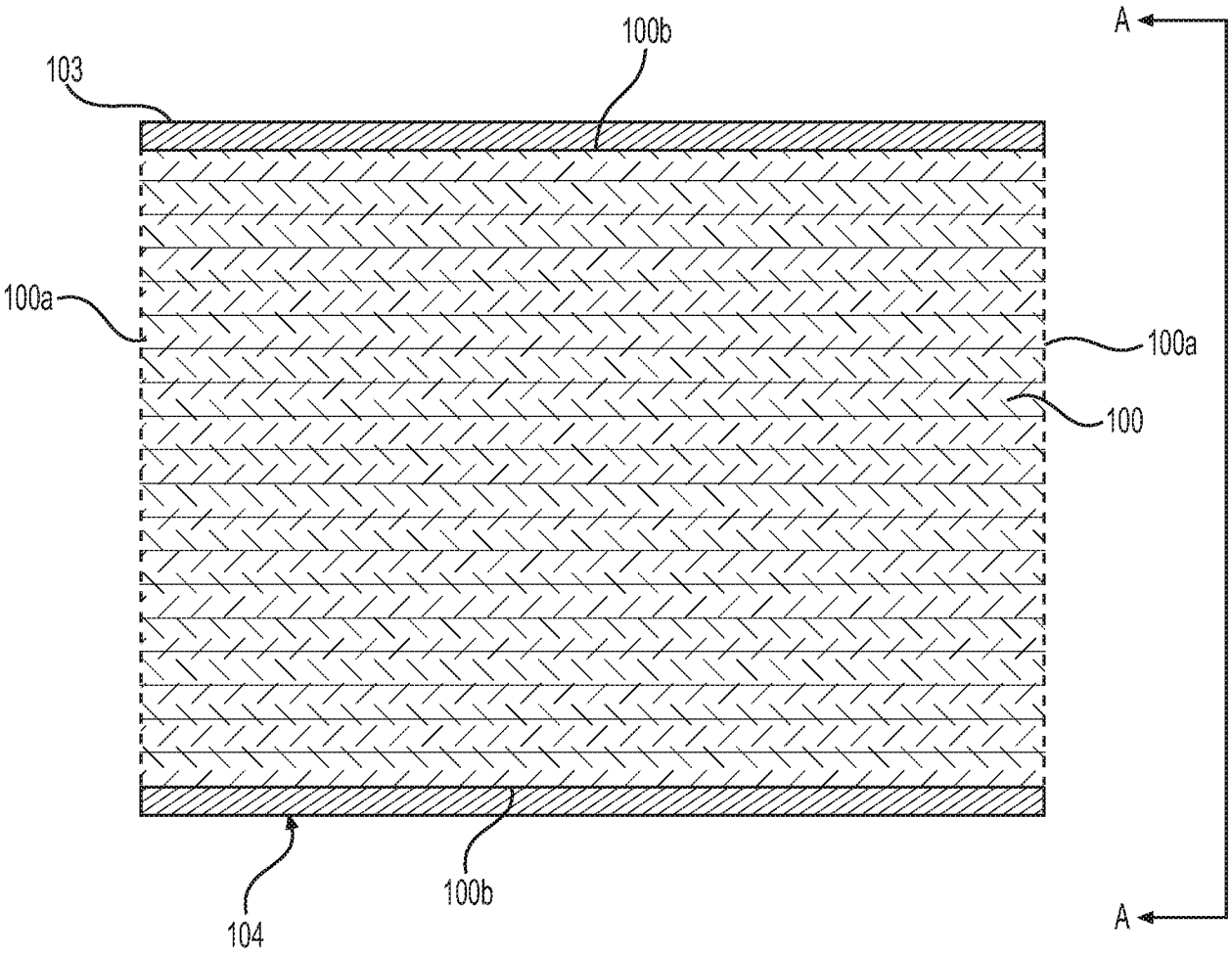
FIG. 1 is an illustration of a side-view of a filter, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Hardware may be implemented using processing or control circuitry such as, but not limited to, one or more processors, one or more Central Processing Units (CPUs), one or more microcontrollers, one or more arithmetic logic units (ALUs), one or more digital signal processors (DSPs), one or more microcomputers, one or more field programmable gate arrays (FPGAs), one or more System-on-Chips (SoCs), one or more programmable logic units (PLUs), one or more microprocessors, one or more Application Specific Integrated Circuits (ASICs), or any other device or devices capable of responding to and executing instructions in a defined manner.

FIG. 1 is an illustration of a side-view of a filter 104, in accordance with an example embodiment. In an example embodiment, the filter 104 includes contained filter material 100 that is infused with a consumable substance. In an example embodiment, the contained filter material 100 is formed from a filter material 105 that is crimped and bound together to form interstices 101 running through a longitudinal length of the contained filter material 100 (see FIGS. 2A-2D), where the interstices 101 provide avenues for an airflow to travel through the length of the contained filter material 100.

Figure 3:
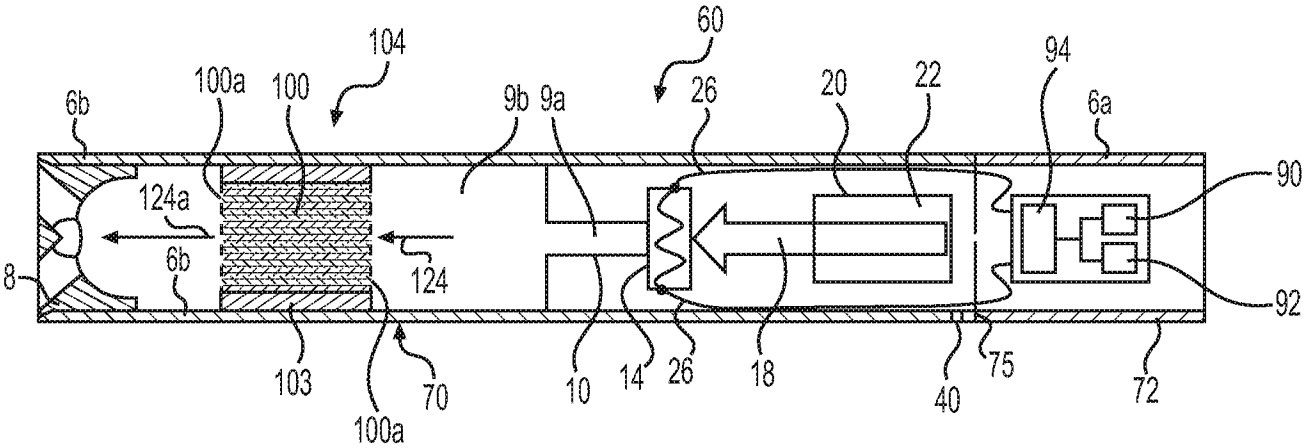
FIG. 3 is a diagram of a device with the filter, in accordance with an example embodiment.
Figure 4:
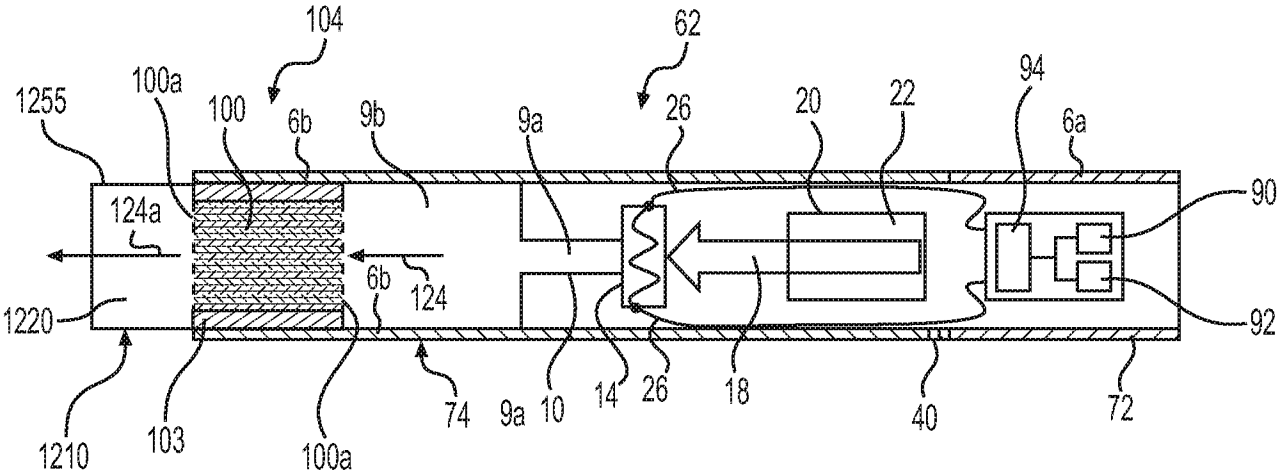
FIG. 4 is a diagram of a device with the filter, in accordance with an example embodiment.
Figure 5:
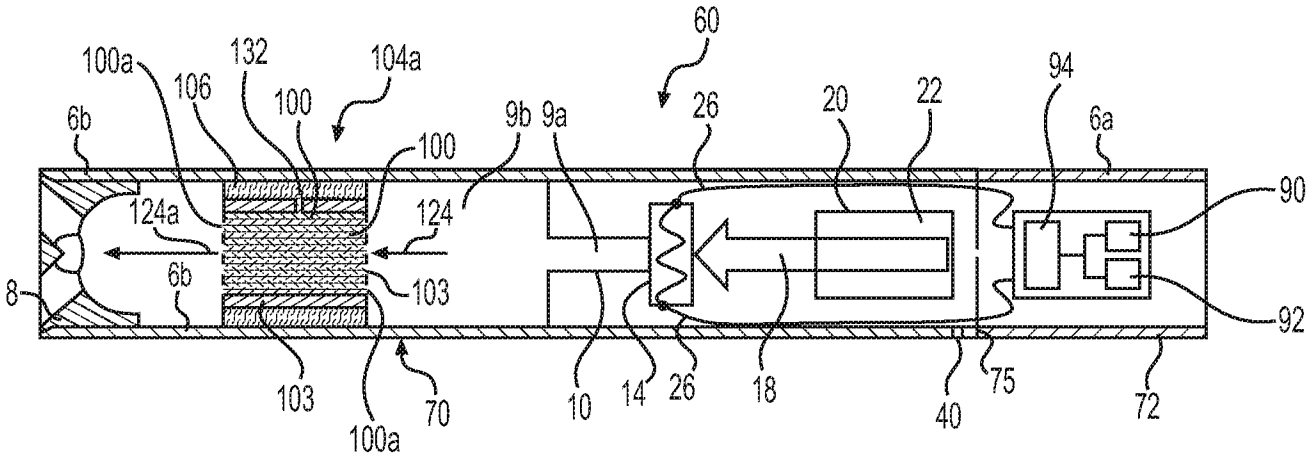
FIG. 5 is a diagram of a device with the filter and a reservoir, in accordance with an example embodiment.

In an example embodiment, the contained filter material 100 is bound together by a containing structure 103. In an example embodiment, the contained filter material 100 and the containing structure 103 combine to form the filter 104 or a part of the filter 104. The filter 104 can be in various shapes or sizes. In an example embodiment, the filter 104 is in the shape of a plug that is sized to be fitted into a housing 6*b*, or on the end of a housing 6*b*, of a device (as shown in FIGS. 3-5). In an example embodiment, the filter 104 is sized to include enough contained filter material 100, and a concentration of the consumable substance (described below) within the contained filter material 100 to provide a determined number of draws and/or a determined number of draws over a desired duration of time.

In an example embodiment, the containing structure 103 fully circumscribes the contained filter material 100. In another embodiment, the containing structure 103 does not cover all sides of the contained filter material 100, and may for instance define openings for an entrance and exit airflow on ends 100*a* of the contained filter material 100. The containing structure 103 may be made from more than one material. In an example embodiment, the containing structure 103 may include a soft and/or porous covering. In an example embodiment, the containing structure 103 may include a covering made from cellulose, plant-based cellulose, fabric, cotton, fibers, threads, other suitable textiles, paper, tipping paper, or combinations or sub-combinations of these materials, etc. In an example embodiment, the containing structure 103 may include a hard shell made from metal, metal alloys, one or more polymers, plastics, resins, etc., where the hard shell may or may not essentially circumscribe the contained filter material 100. The hard shell of the containing structure 103 may be cylindrically-shaped. In the event the containing structure 103 is a hard shell that covers sides of the contained filter material 100, at least one or more openings and/or perforations in the shell may be included to allow airflow to traverse through the contained filter material 100. In an example embodiment, the containing structure 103 on one or both ends 100*a* and/or sides 100*b* of the contained filter material 100 is made from a porous material, and may include a mesh, such as a metal, plastic, resin and/or polymer mesh. The ends 100*a* and/or sides 100*b* of the contained filter material 100 may also, in an example embodiment, be covered by a containing structure 103 that can include a soft and/or porous covering made from cellulose, plant-based cellulose, fabric, cotton, fibers, threads, other suitable textiles, pulp, paper, tipping paper, or combinations, or sub-combinations, of these materials, etc.

In an example embodiment, the filter 104 does not include a containing structure 103, and instead only the crimped and contained filter material 100 constitutes the filter 104. In an example embodiment, the ends 100*a* of the contained filter material 100 are open (e.g., the containing structure 103 defines openings), thereby allowing an airflow to freely enter and exit these ends 100*a* of the contained filter material 100, whereas the sides 100*b* of the contained filter material 100 may or may not include the containing structure 103 that contains the contained filter material 100. In an example embodiment, the containing structure 103 is made from sheets or layers of the filter material 105.

The containing structure 103 and/or the contained filter material 100 of some example embodiments is suitable for allowing airflow to pass through a length of the filter 104, thereby allowing the airflow to pass through ends 100*a* of the contained filter material 100. In an example embodiment, the containing structure 103 and/or the contained filter material 100 can be in a shape other than a plug shape. For instance, the contained filter material 100 can be in the shape of a rod, a disc, a flat surface, a square, a rectangle, or any other desirable shape. In an example embodiment, the filter material 100 may be in the shape of a cylinder, and the containing structure 103 may be wrapped around the cylinder without covering ends 100*a*. Other shapes or cross-sectional configurations may be used.

Filter Material According to Some Example Embodiments

Figure 2A:
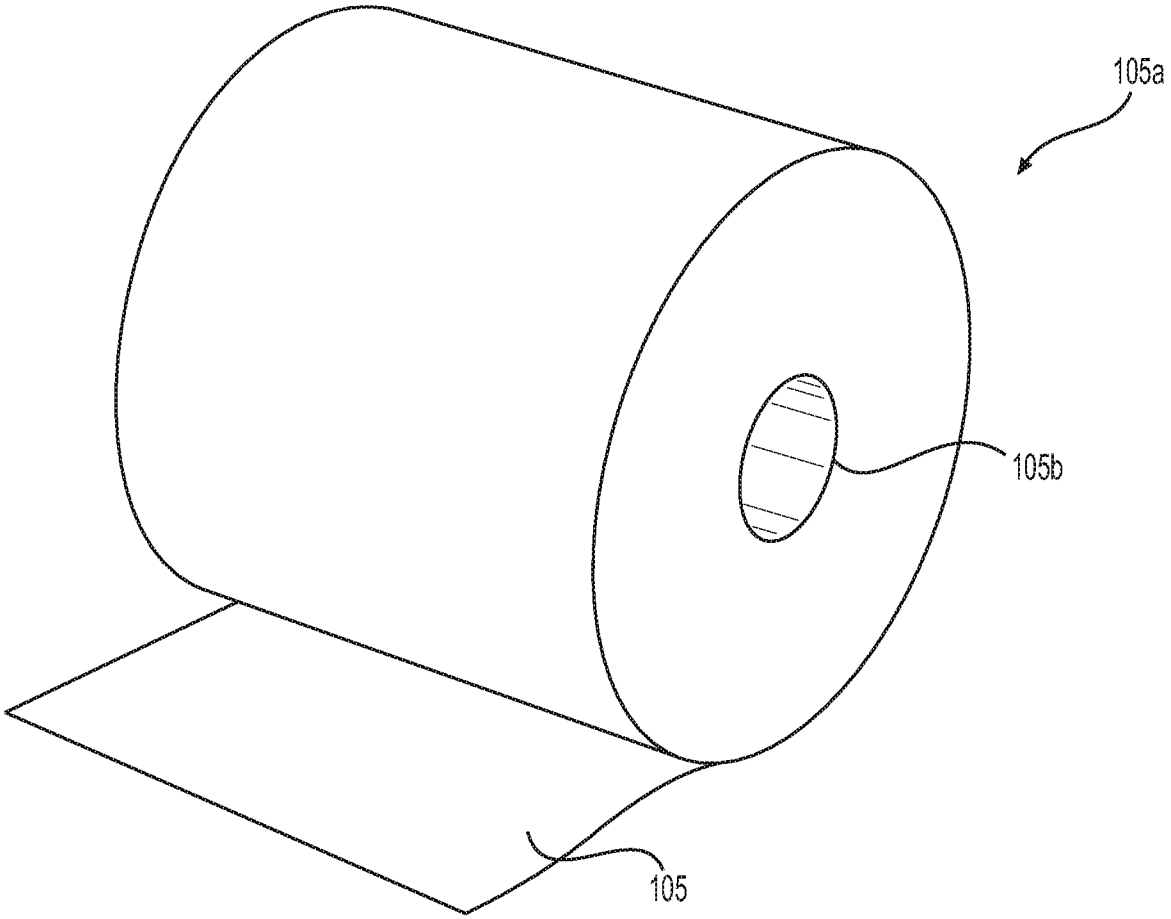
FIG. 2A is an illustration of a roll of filter material, in accordance with an example embodiment.

FIG. 2A is an illustration of a roll 105*a* of the filter material 105, in accordance with an example embodiment. In this embodiment, the filter material 105 is pressed and formed into a flat sheet, where the sheet may be processed and/or stored on rolls 105*a* for convenience. The roll 105*a* may optionally include a mandrel 105*b* that may support the roll 105*a* of the filter material 105. In an example embodiment, the filter material 105 is filter paper.

In other embodiments, the filter material 105 is a block of material, an extruded material, or a material that is in a shape other than a flat sheet. In this embodiment, the filter material 105 is porous and includes interstices within the filter material 105, where the filter material 105 may be formed or pre-formed into a desired shape of a contained filter material 100, without the filter material 105 ever being in a paper-like or sheet-like form prior to formation of the contained filter material 100.

In an example embodiment, the filter material 105 is made from pulp that is 100% soft wood pulp, that is either bleached or non-bleached. In this embodiment, the filter material 105 has a thickness of about 100 micrometers, and a density of about 5 kg/m$^3$. In an example embodiment, the filter material 105 is a composite material that is made from wood pulp and/or paper. In another embodiment, the filter material 105 is made from a plant-based cellulose material. In this embodiment, the filter material 105 is made from a plant-based cellulose material that is either derived from tobacco material or non-tobacco material. In an example embodiment, the filter material 105 has a tensile strength of at least 10 Newton to provide rigidity to the contained filter material 100. In an example embodiment, the filter material 105 has an air permeability of about 4,500 cu, a moisture of less than 5% and an ignition temperature of more than 150° C. In an example embodiment, the filter material 105 is porous, with a pore size that is about 10-12 micrometers, or about 11 micrometers.

In an example embodiment, at some point during the processing of the filter material 105 into the contained filter material 100, the filter material 105 is infused with a consumable substance, where the consumable substance includes nicotine, one or more flavorants and/or a pre-vapor formulation, as described below in more detail.

Figure 2B:
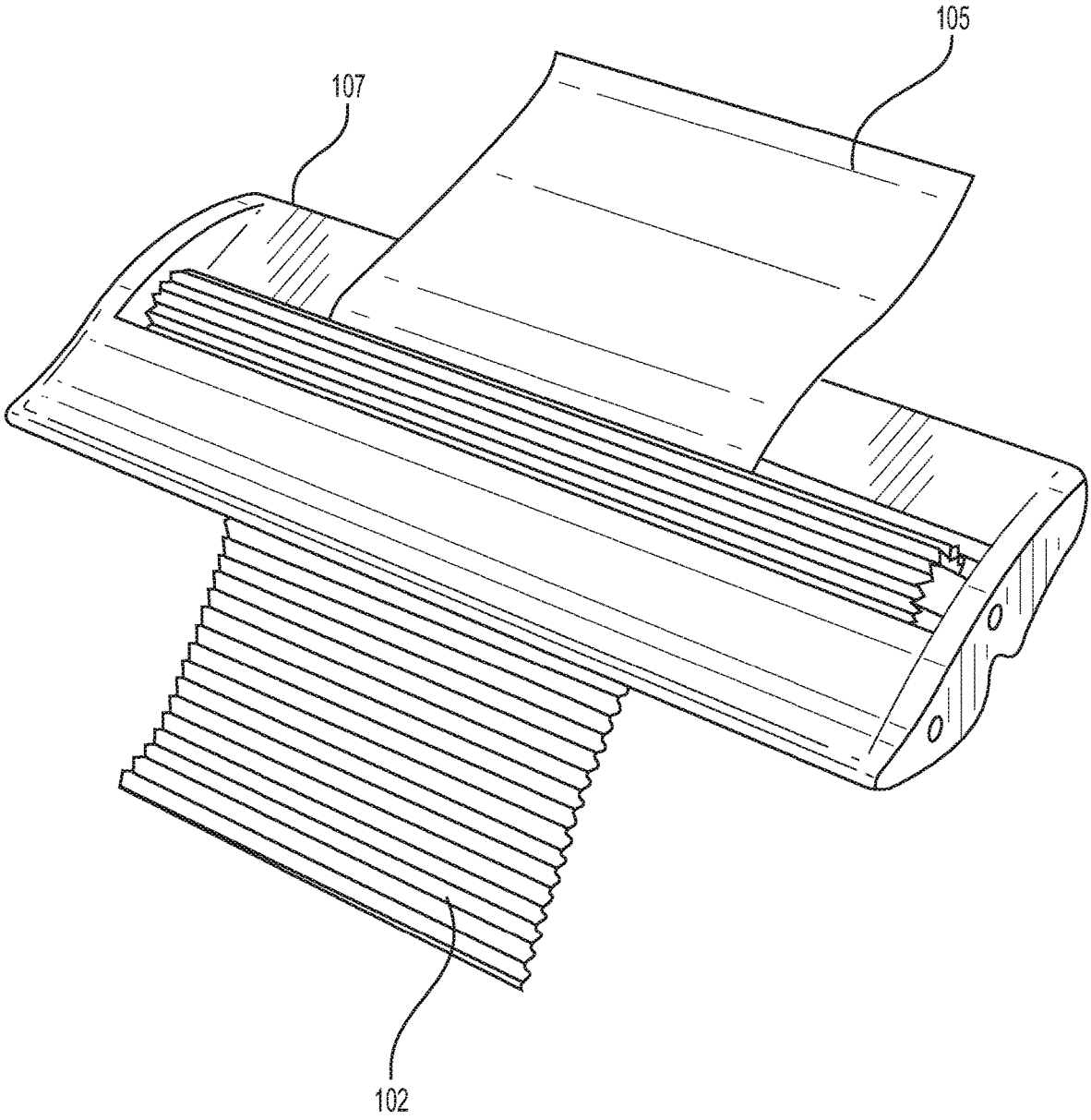
FIG. 2B is an illustration of a sheet of filter material being crimped, in accordance with an example embodiment.
Figure 2C:
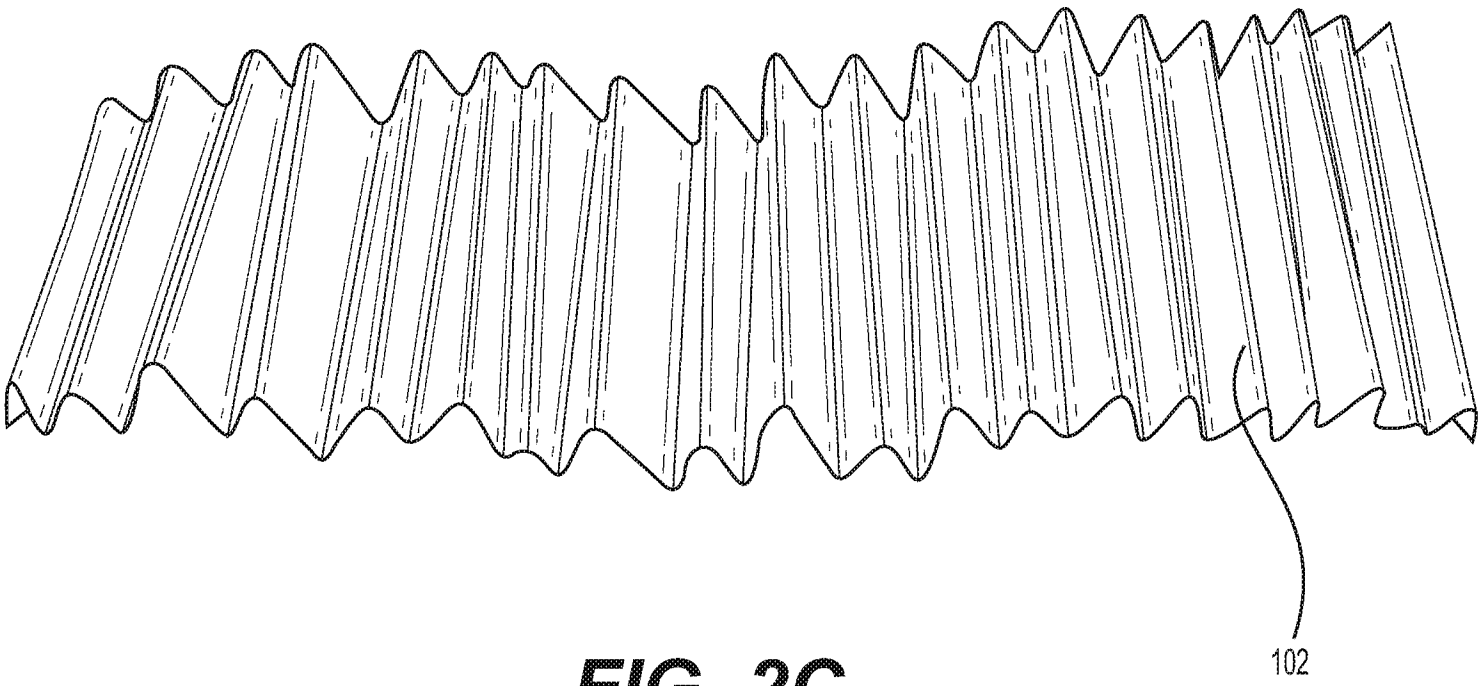
FIG. 2C is an illustration of a crimped sheet of filter material, in accordance with an example embodiment.

FIG. 2B is an illustration of the filter material 105 in the form of a sheet, where the filter material 105 is being crimped, in accordance with an example embodiment. The sheet of the filter material 105 may remain attached to the roll 105*a* during further processing of the filter material 105, or the sheet of the filter material 105 may be cut from the roll 105*a*. Optionally, the sheet of the filter material 105 is formed and stored as the sheet, such that the sheet of the filter material 105 is not part of a roll 105*a*. In an example embodiment, during a crimping process, the filter material 105 is folded and/or pressed to form a crimped filter material 102 (as shown in FIG. 2C). In this embodiment, the crimped filter material 102 includes a profile in a 'W'-shape. The crimping can be performed by any means, including for example, by using any well-known crimping device 107.

In another embodiment, the filter material 105 is formed and processed as a block of material, or another shape of the filter material 105, such that the filter material 105 is not in the form of a flat sheet.

Filter Material: Non-Tobacco Cellulose Example Embodiments

In an example embodiment, the filter material 105 is a non-tobacco material. In an example embodiment, the non-tobacco material is non-tobacco cellulose. In particular, the non-tobacco cellulose is cast or made into the filter material 105, where in an example embodiment the filter material 105 is in the form of a flat sheet-like (paper-like) layer that may or may not be rolled 105*a*. In an example embodiment, the cellulose is a water-insoluble organic polymer material that is made from plant material, plant-based material, plant cell walls, vegetable fibers, cotton, polysaccharide, chains of glucose units (monomers), cellulose acetate, combinations, or sub-combinations, of these materials, etc. In another embodiment, the cellulose is partially water-soluble and made from the same materials, or combinations, or sub-combinations, of the materials, etc.

In an example embodiment, the filter material 105 is about 30% to 99% alpha-cellulose material made from plant material, about 0.01% to 2% ash and the remainder is hemicellulose. In an example embodiment, the hemicellulose is a plant based material that includes beta-cellulose, gamma-cellulose, biopolymers, or combinations, or sub-combinations, thereof. In some examples, the primary strength and water-insoluble properties of the filter material 105 may be derived from the content of alpha-cellulose within the filter material 105. In an example embodiment, the filter material 105 is more than 98% alpha-cellulose material made from plant material, and about 0.01% to 2% ash and the remainder is hemicellulose—where this filter material 105 embodiment is water-insoluble. The ranges of values in these example embodiments are not limiting and may be below or above these ranges.

Filter Material: Tobacco Cellulose Example Embodiments

In an example embodiment, the filter material 105 is a plant-based cellulose derived at least in part from a tobacco plant. The cellulose is cast or made into the filter material 105, where in an example embodiment the filter material 105 is in the form of a flat sheet-like (paper-like) layer that may or may not be rolled 105*a*. In an example embodiment, the filter material 105 is a plant-based cellulose that may or may not include tobacco extract. In an example embodiment, the tobacco cellulose is a water-insoluble material, or alternatively a partially water-soluble material.

In an example embodiment, the filter material 105 is about 30% to 99% tobacco cellulose, about 0.01% to 2% ash and the remainder is hemicellulose. In another embodiment, the filter material 105 is more than 98% tobacco cellulose, about 0.01% to 2% ash and the remainder is hemicellulose—where this filter material 105 embodiment is water-insoluble. The ranges of values in these example embodiments are not limiting and may be below or above these ranges.

FIG. 2C is an illustration of the crimped sheet 102 of the filter material 105, in accordance with an example embodiment. In an example embodiment, the crimped sheet 102 has a side-profile with a W'-shape, as can be seen in FIG. 2D.

Figure 2D:
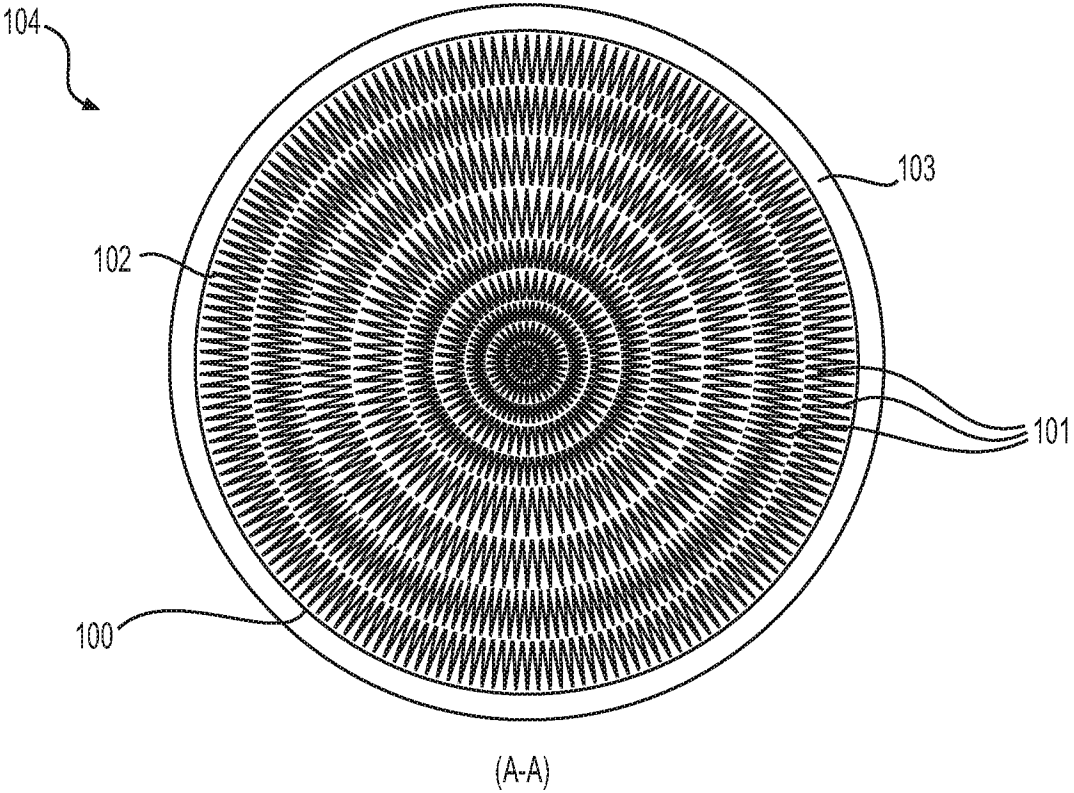
FIG. 2D is an illustration of a cut-away view (A-A of FIG. 1) of the filter, in accordance with an example embodiment.

Physical Characteristics and Performance of the Filter According to Some Example Embodiments FIG. 2D is an illustration of a cut-away view (A-A of FIG. 1) of the filter 104, in accordance with an example embodiment. In this embodiment, the crimped filter material 102 is contained, bound, collected, folded, pressed and/or combined together to form the contained filter material 100, where the crimped filter material 102 has a 'W'-shaped profile, and interstices 101 are defined between the crimped filter material 102. The interstices 101 traverse through the longitudinal length of the contained filter material 100, such that the interstices 101 exist between ends 100*a* of the contained filter material 100 (see FIG. 1).

Existence of the interstices 101, which traverse a length of the contained filter material 100, and which form airflow paths that are parallel to a direction of airflow through a device 60 (see FIG. 3), assist in allowing the filter 104 to offer filtration properties while maintaining a low resistance-to-draw (RTD) across the filter 104. In an example embodiment, the containing structure 103 and/or contained filter material 100 combine to form the filter 104 with a resistance to draw (RTD) between about 5 mm of water to 40 mm of water. Other RTD may be implemented, and in some embodiments, the RTD may be below 5 mm of water or above 40 mm of water. In an example embodiment, the RTD of the filter 104 is about 18 mm of water to 25 mm of water. It should be understood that the RTD of the filter 104 lessens over time as the filter 104 is in operational use.

In another embodiment, in lieu of crimping sheets of the filter material 105 to form the crimped filter material 102 that is then bound together to form contained filter material 100 that includes interstices 101, the filter material 105 can instead be processed in a different manner. For instance, a block of filter material 105 may be formed, where interstices 101 are included in the block of filter material 105. The block of filter material 105 could, for instance, be formed through an extrusion process, where the extrusion process also forms interstices 101 through the block of filter material 105. Additionally, interstices 101 can be formed in the block of filter material 105 via cutting, boring and/or perforating holes or slits through the block of filter material 105.

The contained filter material 100 and/or block of filter material 105 can be considered a 'functional filter material' from the standpoint that it can include flavoring, nicotine and/or a pre-vapor formulation, as described herein.

Flavoring According to Some Example Embodiments

In an example embodiment, flavoring, a flavorant, or a flavor system, is included in the filter material 105 that forms the filter 104, in order to release an aroma and/or flavors during operation, including in some cases, upon heating and/or as an airflow passes through the filter 104. In an example embodiment, the flavoring includes volatile tobacco flavor compounds. Flavoring may also include flavors besides tobacco, or in addition to tobacco flavoring. The flavoring may be a flavorant that is a natural flavorant or an artificial flavorant. For instance, the at least one flavorant may include tobacco flavor, tobacco extract, menthol, wintergreen, peppermint, herb flavors, fruit flavors, nut flavors, liquor flavors, roasted, minty, savory, cinnamon, clove, and any other desired flavors, and combinations, or sub-combinations, thereof.

In an example embodiment, the flavoring is added to the filter material 105, either before or after the filter material 105 is processed into the sheet-like material, or before or after the filter material 105 is bound to form the contained filter material 100 for the filter 104. In some example embodiments, this may be accomplished by dipping the filter material 105 and/or contained filter material 100 in the flavoring, dispersing the flavoring onto the filter material 105 and/or contained filter material 100, or otherwise exposing the filter material 105 and/or contained filter material 100 to the flavoring.

In an example embodiment, the flavoring is infused into the filter material 105 during an initial formation and/or processing of the filter material 105, and prior to being formed into the sheet and/or block of the filter material 105. In an example embodiment, the flavoring is also or alternatively infused into the filter material 105 after the initial formation and/or processing of the filter material 105. In another embodiment, the filter material 105 and/or contained filter material 100 are left unflavored, such that flavoring is not included in the contained filter material 100 of the filter 104.

In an example embodiment, a flavoring system is included in a reservoir 106 in proximity to the contained filter material 100, where the reservoir 106 is in fluid communication with the contained filter material 100 (see FIG. 5). This flavoring system can be in lieu of, or in addition to, a flavoring system that is infused within the filter material 105 and/or contained filter material 100.

Flavoring: Non-Tobacco Flavoring According to Some Example Embodiments

In an example embodiment, the flavoring/flavorant added to the filter material 105 and/or the contained filter material 100 can include a 'tobacco flavoring' that is not tobacco. That is to say, this flavoring is not a tobacco extract, it is not derived from tobacco, and does not include any tobacco material in any form—and yet, this aromatic flavoring sensorially mimics (smells and/or tastes like) tobacco.

Nicotine for Some Example Embodiments

In an example embodiment, nicotine is included in the filter material 105 and/or the contained filter material 100. In one an example embodiment, about 1-15 mg of nicotine is included in each filter 104, or about 1-10 mg of nicotine is included in each filter 104. Less or more nicotine may be used in other example embodiments. In an example embodiment, the filter 104 contains enough nicotine that the initial (first) five "draws" of the filter 104 includes about 100-500 micrograms of nicotine per draw. Less or more nicotine may be used in the filter 104 in other example embodiments to obtain other results. A "draw" is defined to be about 55 $cm^3$ of fluid that flows for a period between about 3-5 seconds.

In an example embodiment, the nicotine is added to the filter material 105, either before or after the filter material 105 is processed into the sheet-like material, or before or after the filter material 105 is bound to form the contained filter material 100 for the filter 104. In some example embodiments, this may be accomplished by dipping the filter material 105 and/or contained filter material 100 in nicotine, dispersing nicotine onto the filter material 105 and/or contained filter material 100, or otherwise exposing the filter material 105 and/or contained filter material 100 to nicotine.

In an example embodiment, nicotine is infused into the filter material 105 during an initial formation and/or processing of the filter material 105, and prior to being formed into the sheet and/or block of the filter material 105. In an example embodiment, the nicotine is also or alternatively infused into the filter material 105 after the initial formation and/or processing of the filter material 105. In another embodiment, the filter material 105 and/or filter 104 does not include nicotine, such that nicotine is not included in the contained filter material 100 of the filter 104.

In an example embodiment, nicotine may be included in a reservoir 106 in proximity to the contained filter material 100, where the reservoir 106 is in fluid communication with the contained filter material 100 (see the example of FIG. 5).

This nicotine can be in lieu of, or in addition to, nicotine that is infused within the filter material 105 and/or contained filter material 100.

Example Embodiments with Pre-Vapor Formulation

In an example embodiment, the flavoring and/or nicotine is included in a pre-vapor formulation, and then the pre-vapor formulation with the flavoring and/or nicotine is infused into the filter material 105. In another embodiment, the pre-vapor formulation is infused into the filter material 105 separately from the flavoring and/or nicotine. The pre-vapor formulation is a material or combination of materials that is transformed into a vapor. Vapor, aerosol and dispersion are terms used interchangeably and are meant to cover any matter generated or output by the devices claimed and equivalents thereof. The pre-vapor formulation may also be a pre-aerosol formulation or a pre-dispersion formulation.

In an example embodiment, the pre-vapor formulation is a liquid, solid and/or gel formulation including, but not limited to, water, beads, solvents, active ingredients, ethanol, plant extracts, natural or artificial flavors, and/or at least one vapor former such as glycerin and propylene glycol.

In an example embodiment, the at least one vapor former of the pre-vapor formulation includes diols (such as propylene glycol and/or 1,3-propanediol), glycerin and combinations, or sub-combinations, thereof. Various amounts of the vapor former may be used. For example, in some example embodiments, the at least one vapor former is included in an amount ranging from about 20% by weight based on the weight of the pre-vapor formulation to about 90% by weight based on the weight of the pre-vapor formulation (for example, the vapor former is in the range of about 50% to about 80%, or about 55% to 75%, or about 60% to 70%), etc. Moreover, in an example embodiment, the pre-vapor formulation includes a weight ratio of the diol to glycerin that ranges from about 1:4 to 4:1, where the diol is propylene glycol, or 1,3-propanediol, or combinations thereof. In an example embodiment, this ratio is about 3:2. Other amounts or ranges may be used.

In an example embodiment, the pre-vapor formulation also includes water. Various amounts of water may be used. For example, in some example embodiments, water may be included in an amount ranging from about 5% by weight based on the weight of the pre-vapor formulation to about 40% by weight based on the weight of the pre-vapor formulation, or in an amount ranging from about 10% by weight based on the weight of the pre-vapor formulation to about 15% by weight based on the weight of the pre-vapor formulation. Other amounts or percentages may be used. For example, in an example embodiment, the remaining portion of the pre-vapor formulation that is not water (and nicotine and/or flavoring compounds), is the vapor former (described above), where the vapor former is between 30% by weight and 70% by weight propylene glycol, and the balance of the vapor former is glycerin. Other amounts or percentages may be used.

In an example embodiment, the pre-vapor formulation includes at least one flavorant in an amount ranging from about 0.2% to about 15% by weight (for instance, the flavorant may be in the range of about 1% to 12%, or about 2% to 10%, or about 5% to 8%). In an example embodiment, the pre-vapor formulation includes nicotine in an amount ranging from about 1% by weight to about 10% by weight (for instance, the nicotine is in the range of about 2% to 9%, or about 2% to 8%, or about 2% to 6%). In an example embodiment, the portion of the pre-vapor formulation that is not nicotine and/or a flavorant, includes 10-15% by weight water, where the remaining portion of the non-nicotine and non-flavorant portion of the formulation is a mixture of propylene glycol and a vapor former where the mixture is in a ratio that ranges between about 60:40 and 40:60 by weight. Other combinations, amounts or ranges may be used.

Device with Filter According to Some Example Embodiments

FIG. 3 is a diagram of a device 60 with a filter 104, in accordance with an example embodiment. In an example embodiment, the device 60 is an e-vaping device. In an example embodiment, the device 60 includes a first section 70 that is a cartridge. In an example embodiment, the first section 70 includes a reservoir 20 that contains a pre-vapor formulation 22 (such as the pre-vapor formulation described above). In an example embodiment, the reservoir 20 is in fluid communication with a heater 14 in the first section 70. In particular, a structural transport 18 may allow the pre-vapor formulation 22 to travel from the reservoir 20 to the heater 14. In an example embodiment, the structural transport 18 includes a physical structure at least partially utilizing capillary action, gravity, piezoelectric power, solar power, absorption, osmosis, a pressure gradient, applied pressure, other modes of fluid transfer, or combinations/sub-combinations thereof, to allow, cause and/or force the pre-vapor formulation 22 to travel from the reservoir 20 to the heater 14.

In an example embodiment, the device 60 includes a second section 72. In an example embodiment, the second section 72 is a power section. The second section 72 may be connectable to the first section 70. In an example embodiment, the second section 72 includes a control system 1. In an example embodiment, the control system 1 includes a controller 90 that is operationally connected to a power supply 94 and at least one sensor 92, such as a pressure sensor and/or a temperature sensor. The sensor(s) 92 can be located in the first section 70 or the second section 72. In an example embodiment, the at least one sensor 92 is operationally constructed to measure one or more of the following: a resistance of the heater 14, a temperature of the heater 14 and/or a draw of airflow through the device 60. In an example embodiment, the controller 90 of the control system 1 receives an input signal, or signals, from the sensor(s) 92, and the controller 90 controls operations of the device 60, including supplying an electrical current from the power supply 94 to the heater 14 to vaporize the pre-vapor formulation based at least in part on the signal(s) from the sensor(s) 92. In an example embodiment, the control system 1 is operationally and electrically connected to the heater 14 via electrical leads 26 that allow the control system 1 to selectively send the electrical current to the heater 14. Both sections 70/72 can include the respective housing **6*b*/6*a*, where the sections may be connected by a connecting structure 75. The vapor thus formed is evacuated out of the device 60 via a mouth-end insert 8. In an example embodiment, one or more air inlets 40 are included in the housing 6*a* and/or housing 6*b* (either in the first section 70, or the second section 72 of the device 60). The housings 6*a*/6*b* in FIG. 3 may be the same or different shapes, such as for example cylindrical, square, rectangular, triangular, polygonal, curved, irregular, etc. In an example embodiment, the air inlet(s) 40 are used to establish an airflow path through the device 60 that may exit the mouth-end insert 8, where the heater 14 and the filter 104 are in, or otherwise exposed to, the airflow path. In an example embodiment, the control system 1** is in fluid communication with the airflow path.

In an example embodiment, the first section 70 includes the filter 104. In the first section 70, the filter 104 is positioned to cause the contained filter material 100 to reside in a path of vapor flow 124 that is defined by the device 60. Vapor 124 leaving the heater 14 passes through the contained filter material 100. In doing so, the filter 104 may physically filter the vapor 124, while also creating a downstream vapor 124*a* that includes entrained flavoring, nicotine and/or the pre-vapor formulation from the filter 104, as described below in more detail. Vapor, aerosol and dispersion are used interchangeably and are meant to cover any matter generated or output by the devices and/or elements of the devices claimed and equivalents thereof.

In an example embodiment, the filter 104 is sized so that sides of the containing structure 103 are pressure-fitted into an outer air passage 9*a*, or a second (enlarged) outer air passage 9*b* (notice that FIG. 3 shows the filter 104 only in the second outer air passage 9*b*), or both in the event the device 60 includes more than one filter 104. In an example embodiment with a filter 104 without a containing structure 103, the filter 104 can be sized so that the filter material 100 is pressure-fitted into an outer passage 9*a*, 9*b*, or both. The filter 104 is to be positioned downstream of a heater 14, and may be located near a mouth-end insert 8 for the device 60. Alternatively to pressure-fitting, the filter 104 may instead be held in place via an adhesive, set screws, a snap-fit connecting structure, or any other structure necessary to hold the filter 104 in place within the first section 70.

In the example embodiment shown in FIG. 3, the containing structure 103 may be on one or both ends 100*a* of the contained filter material 100. In an example embodiment, the containing structure 103 includes screens and/or a porous material, as described above, in order to allow the vapor 124 to freely flow through the contained filter material 100. Meanwhile, sides 100*b* of the contained filter material 100 include a containing structure 103 that may be a soft, hard or solid material, as described above, in order to allow the filter 104 to firmly grip and/or be adhered to and/or pressure fitted to the housing 6*b* and/or inner passage 10 of the first section 70 and be held in place. In another embodiment, as described above, the contained filter material 100 may constitute an entirety of the filter 104, such that the containing structure 103 is not present. Or, the filter 104 may only have the containing structure 103 on sides 100*b* of the contained filter material 100, such that one or both ends 100*a* of the contained filter material 100 are open (e.g., the containing structure 103 may not be present on the ends 100*a*).

In an example embodiment, the filter 104 is affixed within the first section 70. In this embodiment, the first section 70 may be disposable. In another embodiment, the filter 104 is temporarily held within the first section 70, such that the filter 104 is removable and replaceable prior to the useful end-life of the first section 70, allowing the first section 70 to be non-disposable and/or be re-used with replacement filters 104. In this embodiment, the filter 104 may allow for the flavoring system, the nicotine and/or the pre-vapor formulation to be added or recharged within the filter 104, so that the filter 104 can then be reinstalled into the first section 70. In another embodiment, the filter 104 is removable and replaceable with a new filter 104, where the filter 104 may be disposable. Or, a containing structure 103 of the filter 104 may be removable, or remain affixed within the first section 70, where only the contained filter material 100 may be removed and replaced from the containing structure 103, such that the containing structure 103 is reusable and the contained filter material 100 is replaceable. In yet another embodiment, rather than the filter 104 being removable and replaceable, or in addition to the filter 104 being removable and replaceable, the first section 70 may allow for access to the contained filter material 100 and/or filter 104 in order to allow the flavoring system, nicotine and/or the pre-vapor formulation to be added or recharged within the contained filter material 100 and/or filter 104.

In an example embodiment, the reservoir 20 contains a supply of the pre-vapor formulation 22 that is hated by heater 14 to generate a vapor, where this pre-vapor formulation 22 supply is separate from a pre-vapor formulation that is infused into the filter material 105 of the contained filter material 100. In an example embodiment, the pre-vapor formulation 22 includes flavoring and/or nicotine that is the same as the flavoring and/or nicotine described above, or alternatively that is different than the flavoring and/or nicotine described above, or alternatively the pre-vapor formulation 22 may instead not contain other flavoring and/or nicotine. In an example embodiment, the flavoring and/or nicotine may be provided by flavoring and/or nicotine in contained filter material 100, as vapor generated by heater 14 flows through the contained filter material 100.

In an example embodiment, the heater 14 is in communication with the inner passage 10. In an example embodiment, the inner passage 10 is cylindrical in shape, though the inner passage 10 may also be a different shape and may have, for instance, a cross-sectional profile that is square, rectangular, triangular, polygonal, irregular, etc. In an example embodiment, the heater 14 is constructed of an iron-aluminide (e.g., FeAl or $Fe_3Al$).

As stated above, the heater 14 is upstream of the filter 104. The heater 14 heats the pre-vapor formulation 22 in order to produce a vapor 124, where the vapor 124 is warmed to an extent that the warm vapor 124 can at least partially extract (e.g., vaporize, elute, etc.) the flavoring, nicotine and/or ingredients of a pre-vapor formulation in the contained filter material 100, as the vapor 124 flows through the contained filter material 100 to produce a downstream vapor 124*a* that exits the filter 104. In an example embodiment, the heater 14 is a distance apart from the contained filter material 100 and/or filter 104, such that convection indirectly heats the contained filter material 100, as well. In an example embodiment, the heater 14 is in a channel with a smaller diameter and/or smaller cross-sectional area for airflow (e.g., inner passage 10), relative to the channel (air passage 9*b*) containing the filter 104. In other example embodiments, the channel containing the heater 14 and the filter 104 is a channel with a same diameter and/or a same airflow cross-sectional area.

In an embodiment, the heater 14 is in the form of a wire coil, a planar body, a ceramic body, a single wire, a cage of resistive wire, or any other suitable form that is configured to vaporize the pre-vapor formulation 22. In at least one example embodiment, the heater 14 is formed of any suitable electrically resistive material or materials. In another example embodiment, the heater 14 is a ceramic heater having an electrically resistive layer on an outside surface thereof.

In an example embodiment, the mouth-end insert 8 of the first section 70 is permanently affixed on an end of the first section 70, or alternatively the mouth-end insert 8 is removable. In an example embodiment where the mouth-end insert 8 is removable, this may allow the filter 104 to also be replaceable and/or refillable from an open end of the housing 6*b* that is provided when the mouth-end insert 8 has been removed.

A position of the heater 14 is not limited to the position shown in FIG. 3, nor is the position of the filter 104 limited to the position shown in FIG. 3. For example, the heater 14 may be positioned at a downstream end of the outer air passage 9*a*, such that the heater 14 may be closer to the contained filter material 100. In an example embodiment, the heater 14 may protrude out of the outer air passage 9*a* and into the second outer air passage 9*b*. Meanwhile, the filter 104 may be set closer to the mouth-end insert 8, or closer to the outer air passage 9*a*. Furthermore, the filter 104 may be positioned in the narrower outer air passage 9*a*, either in lieu of the filter 104 being positioned in the second outer air passage 9*b*, or in addition to a filter 104 also being positioned in the second air passage 9*b*. In an example embodiment, more than one filter 104 is included in the first section 70. In some embodiments, only an outer air passage 9*b*, without an air passage 9*a*, may be included, with the heater 14 and the filter 104 in fluid communication via the air passage 9*b*.

In some example embodiments, the heater 14 warms the contained filter material 100, but the heater 14 does not burn and/or combust the filter 104 and/or the contained filter material 100. Thus, the contained filter material 100 in some example embodiments is non-combustible. Because the first section 70 includes the heater 14 that vaporizes the pre-vapor formulation 22, but otherwise the device 60 does not combust any material, the first section 70 and/or the device 60 may be referred to as a "non-combustible device."

In an example embodiment, the power supply 94 is a battery, such as a lithium ion battery. The battery may be a Lithium-ion battery or one of its variants, for example a Lithium-ion polymer battery. Alternatively, the battery is a Nickel-metal hydride battery, a Nickel cadmium battery, a Lithium-manganese battery, a Lithium-cobalt battery, a fuel cell or a solar cell. Any other power sources or battery technology may be used. In an example embodiment, second section 72 may be usable until the energy in the power supply 94 of the control system 1 is depleted and/or lowered below a certain threshold. Alternatively, the power supply 94 of the control system 1 may be rechargeable and reusable, and may include circuitry allowing the battery to be chargeable by an external charging device, or may be rechargeable via solar power. In some example embodiments, the circuitry of the control system 1, when charged, may provide power for a desired (or alternatively, a determined) number of draws, until the energy in power supply 94 is depleted, and/or until the energy in power supply 94 is lowered below a certain threshold, after which the circuitry must be reconnected to an external charging device.

In an example embodiment, the first section 70 is connectable to the second section 72 via the connecting structure 75. In an embodiment, the connecting structure 75 can include a threaded connection. A friction fitting, a snap fitting, an adhesive, a removable and/or insertable pin, a magnetic connection, or any other suitable structure may be used to join the sections 70/72 to each other. Optionally, the second section 72 is permanently connected to the first section 70, such that the second section 72 may be an integral section of the first section 70. In an example embodiment, the device 60 does not have separate sections 70/72, such that the device 60 is one singular section. Or, alternatively, the device 60 may include more than two sections. In an example embodiment, the section 70, or sections 70/72 collectively, define an airflow path for the device 60, where the heater 14 and the filter 104 are in communication with this airflow path.

Example Operation of Some Example Embodiments

In some examples, airflow through the device 60 may be caused by air being drawn into the air inlet(s) 40 and through the first section 70. In outer air passage 9*a*, the airflow may become entrained (eluted) by vapor that may be produced by the heater 14 heating a pre-vapor formulation 22. In the second outer air passage 9*b*, the heated vapor 124 may pass through the contained filter material 100 of the filter 104 in order to allow the vapor to become entrained by added flavoring and/or nicotine from the contained filter material 100, prior to the downstream vapor 124*a* exiting the device 60. As noted, in some embodiments, there may be only one air passage 9*b*, and vapor produced by the heater 14 will go directly to the air passage 9*b*, where the vapor 124 may pass through the contained filter material 100 of the filter 104 in order to allow the vapor to become entrained by added flavoring and/or nicotine from the contained filter material 100, prior to the downstream vapor 124*a* exiting the device 60.

In an example embodiment, an airflow through the device 60 activates the device 60. The sensor(s) 92 may be configured to generate an output indicative of an airflow, a magnitude of an airflow, and/or a direction of an airflow, where the controller 90 may receive the output from the sensor(s) 92 output and determine if the following internal conditions exist: (1) a direction of the airflow indicates a draw of airflow through the device 60 (versus blowing air through the device 60), and/or (2) a magnitude of the airflow exceeds a threshold value. In some example embodiments, only one condition may be sufficient to activate the heater, while in other examples, two conditions or all conditions may have to be met before activating the heater. If these internal conditions of the device 60 are met, the controller 90 electrically connects the power supply 94 to the heater 14, thereby activating the heater 14. In an example embodiment, the sensor(s) 92 generate a variable output signal that is in at least partial correlation with a magnitude of a pressure drop sensed by the sensor(s) 92. In an example embodiment, the controller 90 may send a variable electrical current to the heater 14 based on the variable output signal from the sensor(s) 92. The sensor(s) 92 may include a sensor as disclosed in "Electronic Smoke Apparatus," U.S. application Ser. No. 14/793,453, filed on Jul. 7, 2015, or a sensor as disclosed in "Electronic Smoke," U.S. Pat. No. 9,072,321, issued on Jul. 7, 2015, each of which are hereby incorporated by reference in their entirety into this document. Other type of sensors to detect an airflow may be used.

FIG. 4 is a diagram of another device 62 with the filter 104, in accordance with an example embodiment. Reference numbers in common with FIG. 3 are not described again here, for brevity sake. In an example embodiment, the filter 104 includes a second filter 1220 that is a non-consumable filter (does not include a consumable substance), that may for instance be a cellulose acetate (CA) filter. A portion of the containing structure 103 and/or filter 104 may be connected to the second filter 1220 via any known means and/or structure, including but not limited to an adhesive, a covering or the containing structure 103 (e.g., tipping paper covering filter 1220 and the filter 104, or the containing structure 103 being extended to cover both the filter 104 and filter 1220, etc.), prongs, pins, etc. The second filter 1220 may be circumscribed at least in part by a covering 1255, where the covering 1255 may be a foil, tipping paper, or other material that allows the downstream vapor 124*a* to pass through the second filter 1220 at least through an upstream and downstream end of the filter. As noted, in some examples, covering 1255 may cover filter 1220, containing structure 103 may contained filter material 100, and both may be then covered by an additional covering connecting the two, or, covering 1255 and containing structure 103 may form part of the same cover that covers both filter 1220 and contained filter material 100. In another example, containing structure 103 may cover contained filter material 100, and a separate covering may cover the filter 1220 and the containing structure 103. Other variations may be used that connect filter 1220 and contained filter material 100. In an example embodiment, the filter 104 and the second filter 1220 may be removed from the first section 74 of the device 62 as one element, and a replacement filter 104 with filter 1220 may be inserted into the device 62. In another embodiment, the filter 104 is not connected to the second filter 1220, and instead the filter 104 is on an end of the device 62, where the filter 104 is removable from the end of the device 62. In an example embodiment, the filter 1220 takes the place of a mouth-end insert (such as the mouth-end insert 8 of FIG. 3), such that a separate mouth-end insert is not present.

In an example embodiment, dilution air (not shown) is introduced into the flow of the downstream vapor 124*a* prior to the vapor 124*a* exiting the device 62. This may be accomplished, for example, by perforating sides of the covering 1255 of the second filter 1220.

FIG. 5 is a diagram of another device 60*a* with a filter 104*a* that includes a reservoir 106, in accordance with an example embodiment. Reference numbers in common with the previous embodiments are not described again here, for brevity sake. In an example embodiment, the reservoir 106 contains nicotine, the flavorant and/or the pre-vapor formulation. The reservoir 106 is in fluid communication with the contained filter material 100 of the filter 104*a*. In particular, a wick system 132, such as a wick, a capillary tube, a narrow channel, or other structure capable of communicating nicotine, the flavorant and/or the pre-vapor formulation from the reservoir 106 to the contained filter material 100, is used to provide nicotine, flavorant and/or a pre-vapor formulation to the contained filter material 100 during operation of the device 60*a*, and/or is used to replenish the nicotine, flavorant and/or pre-vapor formulation within the contained filter material 100 during operation of the device 60*a*.

In an example embodiment, the filter 104*a* and reservoir 106 is removable in order to allow the reservoir 106 to be re-filled after being depleted. In another embodiment, the reservoir 106 is re-fillable without the filter 104*a* and/or the reservoir 106 being removed from the first section 70. In another embodiment, the filter 104*a*, the reservoir 106 and/or the first section 70 is disposable, such that any or all of these elements may be disposed following depletion of the contained filter material 100 and/or reservoir 106.

In another embodiment, rather than a separate dedicated reservoir 106 being in fluid communication with the contained filter material 100 of the filter 104*a*, instead the reservoir 20 within the first section 70 is in fluid communication with the contained filter material 100. That is to say, in this embodiment, the reservoir 20 is in fluid communication with both the contained filter material 100 and the heater 14.

Insert Examples According to Example Embodiments

Figure 6A:
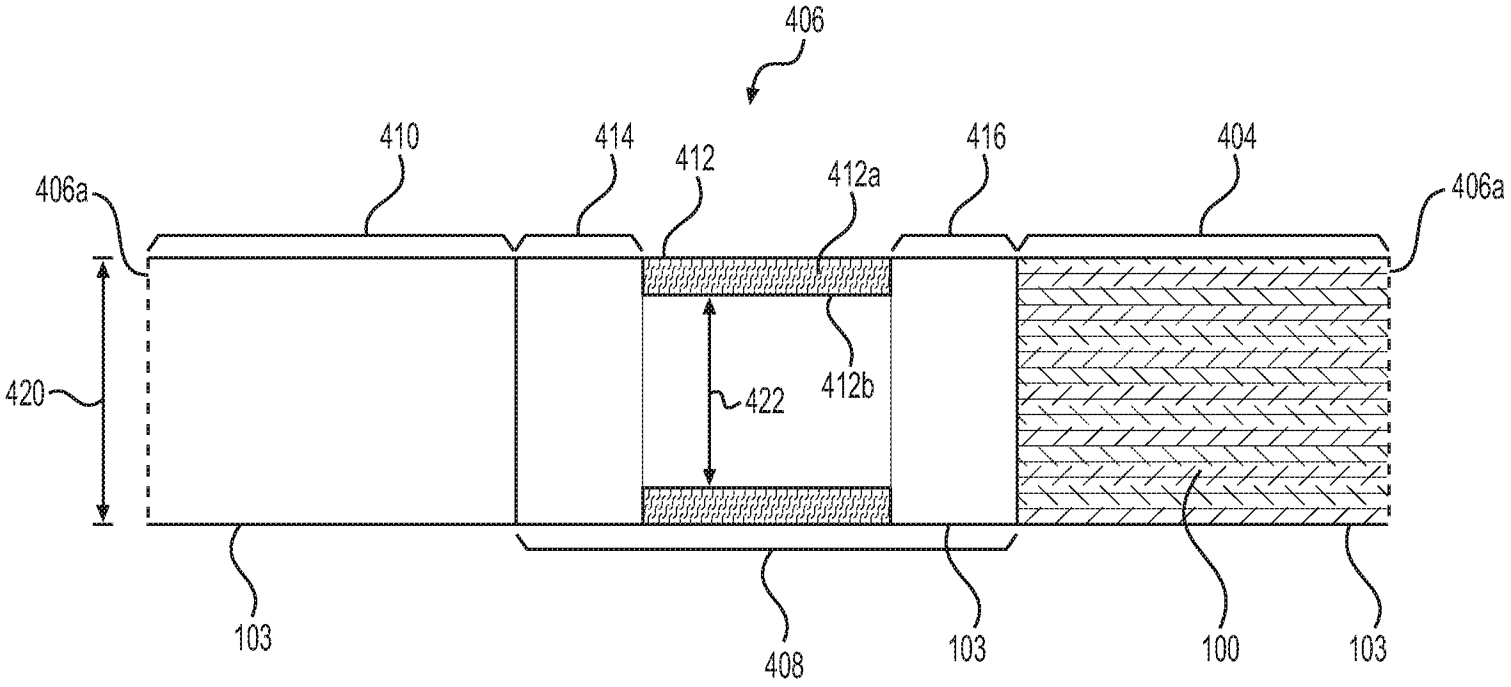
FIG. 6A is an illustration of a side-view of a filter in an insert, in accordance with an example embodiment.

FIG. 6A is an illustration of a side-view of a filter 404 in an insert (insertable rod) 406, in accordance with an example embodiment. In an example embodiment, the insert 406 includes at least three sections: a proximal end section that is the filter 404, a middle section 408, and a distal end section that is a filter 410. The filter 410 in some example embodiments is a non-consumable filter that does not include a consumable substance (e.g., the 410 is devoid of a consumable substance). The insert 406 has a "plug-space-plug" configuration, from the standpoint that the middle section 408 is largely a section of open (void) space (e.g., wrapped by a tipping paper that can also wrap the other sections). In some examples, the middle section 408 may include a flow restrictor 412. The flow restrictor 412 may be in the form of a tube with thick walls 412*a*, where an internal surface 412*b* of the tube walls forms a restricted flow channel with a restricted diameter 422. In this embodiment, the filter 404 includes the contained filter material 100 that is formed from the filter material 105, as described above. In an example embodiment, the middle section 408 defines open spaces 414/416 that bracket the flow restrictor 412, such that the flow restrictor 412 does not reach the ends of the middle section 408. In some examples, the flow restrictor 412 may reach both ends of the middle section 408, or may reach one end but not both ends of the middle section 408. The reduced internal diameter 422 of the flow restrictor 412 reduces an airflow cross-sectional area through the middle section 408 to control a RTD and an airflow through the rod 406. The non-consumable filter 410 is a filter that may be, for instance, a cellulose acetate (CA) filter. In an example embodiment, a filter 410 (or other filters described in various embodiments) may also contain nicotine, flavorants, etc. In some embodiments, flavorant beads and/or pressure beads may be included in one or more of the sections. In an example embodiment, an airflow through the insert 406 flows in a direction that causes the airflow to enter and flow through the contained filter material 100, before passing through the middle section 408 and the non-consumable filter 410. In some examples, and insert 406 may include less than three sections or more than two sections. For example, one example may include a filter section and a filter 104 as has been described, or another example may include a sections such as middle section 408 and a filter 104, and in other examples may then include three sections with additional spaces, sections such as middle section 408, filter sections and/or filter 104 sections.

In an example embodiment, the insert 406 includes the containing structure 103 that spans the length of the rod 406, by covering the outer surfaces of the filter 404, the middle section 408 and the non-consumable filter 410 and/or any other sections that may form part of the insert 406. In an example embodiment, the only wrapping around the matrix 100, middle section 408, filter section 410 and/or any other sections that may form part of the insert 406, is a containing structure 103 without any other wrapping around each of the sections that form part of insert 406 (i.e., the sections being wrapped only by and connected by a single wrapping such as containing structure 103). In an example embodiment, the containing structure 103 is made from tipping paper. In another embodiment, the ends 406*a* of the insert 406 are made from any of the materials for the containing structure 103 of the example embodiments described herein. In an example embodiment, the ends 406*a* of the insert 406 are open (e.g., the containing structure 103 is only wrapped around insert 406 in a longitudinal direction, such that the containing structure 103 does not exist on the ends 406*a* of the rod 406). In another embodiment, the containing structure 103 exists on the ends 406*a* of the rod 406 are made from any of the materials described in conjunction with the containing structure 103, included in the embodiments herein. It should be understood that the insert 406 with the filter 404, the middle section 408 and the non-consumable filter section 410, can collectively be considered a filter. One or more sections may also have their own cover, and then the various sections may be connected together, either by another covering or by other structure.

Dimensions and Performance in Some Example Embodiments

In an example embodiment, the diameter 420 of the insert 406 is about 7-10 mm, or about 8.6 mm. In an example embodiment, the internal (restricted) diameter 422 of the flow restrictor 412 is about 4-8 mm, or about 5 mm. In an example embodiment, a longitudinal length of the filter 404 is about 5-16 mm, or about 6 mm. In an example embodiment, a longitudinal length of the middle section (flow restriction section) 408 is about 12-25 mm, or about 12 mm. In an example embodiment, the spaces 414/416 of the middle section 408 may each have a longitudinal length of about 4 mm. In an example embodiment, a longitudinal length of the non-consumable filter 410 is about 6-9 mm, or about 6 mm. In an example embodiment, the RTD of the insert 406 is about 30 mm of water or less, or about 26 mm of water or less. In an example embodiment, the insert 406 has the following dimensions: the filter 404 has a longitudinal length of about 6 mm, the middle section 408 has a longitudinal length of about 12 mm with spaces 414/416 that are each about 4 mm long, and the non-consumable filter 410 has a longitudinal length of about 6 mm—with a RTD of the insert 406 being about 26 mm of water or less. It should be understood that the existence of the void space within the middle section 408, and a size of the internal diameter 422 of the flow restrictor 412, help control an airflow rate and a RTD of the insert 406, where a lower RTD generally allows a greater amount of flavor and/or nicotine to be imparted to the downstream vapor 124*a* exiting the insert 406 (see FIG. 7). The ranges of values in these example embodiments are not limiting and may be below or above these ranges.

In an example embodiment, the insert 406 is disposable, such that the insert 406 may be discarded following a depletion of the consumable substance within the contained filter material 100 of the filter 404.

Figure 6B:
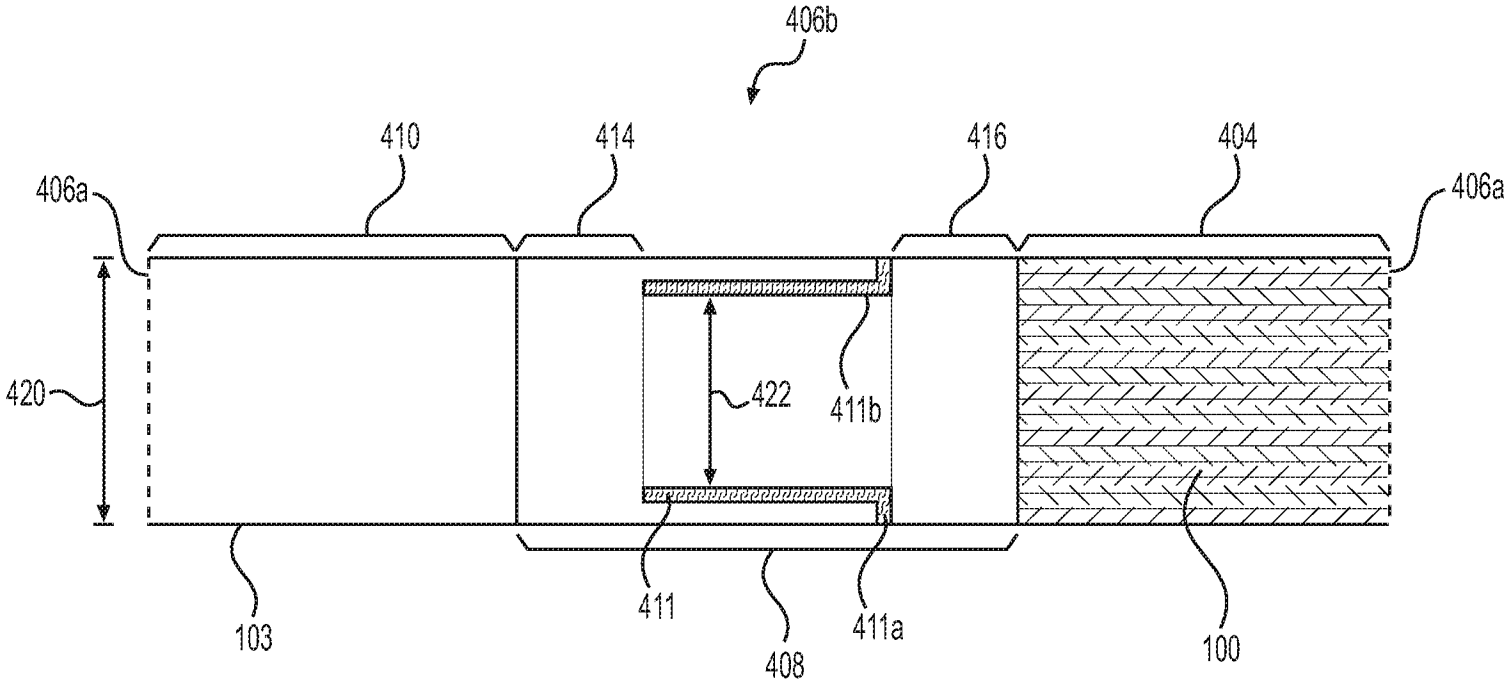
FIG. 6B is an illustration of a side-view of a filter in an insert, in accordance with an example embodiment.

FIG. 6B is an illustration of a side-view of the filter 404 in an insert (insertable rod) 406*b*, in accordance with an example embodiment. Reference numbers in common with FIG. 6A are not described again here, for brevity sake. In this embodiment, the flow restrictor 411 is a "hat" flow restrictor. In this embodiment, the flow restrictor 411 relies on a brim 411*a* of the flow restrictor 411 to provide the reduced cross-sectional airflow through the restrictor 411, where an internal surface 411*b* of the restrictor 411 defines a channel with the restricted diameter 422. In an example embodiment, an airflow through the insert 406*b* flows in a direction that causes the airflow to enter and flow through the contained filter material 100, before passing through the middle section 408 and the non-consumable filter 410.

Device with Insert According to Some Example Embodiments

Figure 7:
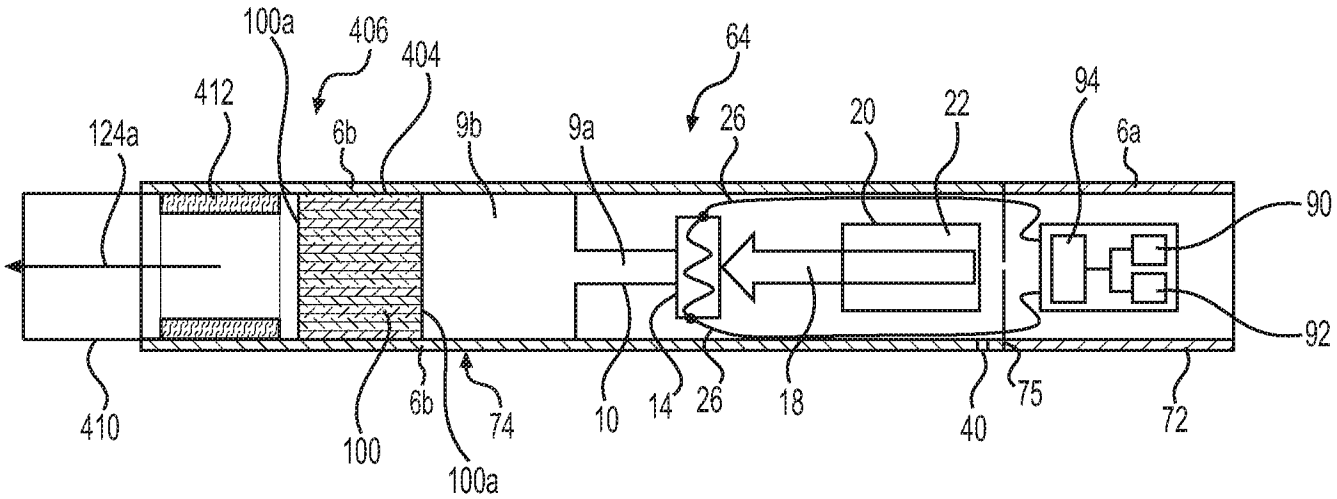
FIG. 7 is a diagram of a device with a filter in the insert, in accordance with an example embodiment.

FIG. 7 is a diagram of a device 64 with the filter 404 in the insert (insertable rod) 406, in accordance with an example embodiment. In an example embodiment, insert 406*b* is substituted for insert 406 in this device 64. Reference numbers in common with FIGS. 3 and 6A are not described again here, for brevity sake. In an example embodiment, the insert 406 is insertable into a distal (downstream) end of the first section 74 of the device 64. In an example device 64 includes multiple sections—e.g., a first section 74 and a second section 72—the insert is insertable into a distal (downstream) end of first section 74. The insert 406 (or 406*b*) may, for instance, be friction-fitted within the end of the device 64. In an example embodiment, the insert extends, at least partially, from the distal end of the device 64, such that at least part of the insert remains exposed and extends outside of device 64 once the insert is fully inserted into the device 64. In an example embodiment where at least part of a filter section 410 of an insert remains outside of the device 64 when the insert is inserted into the device, the filter 410 may act as a mouthpiece for the device 64. As stated above, the insert 406 (or 406*b*) may be disposable, whereas the device 64 and/or one or more sections thereof (if the device includes multiple sections) need not be disposable. The arrangement of the sections of an insert 406 (or 406*b*) may differ from the order shown in the drawings 9A and 9B, and depending on the arrangement, one or more sections other than the filter section may remain outside of the device 64 when the insert is inserted, and may act as a mouthpiece.

Example Methods According to Some Embodiments

Figure 8:
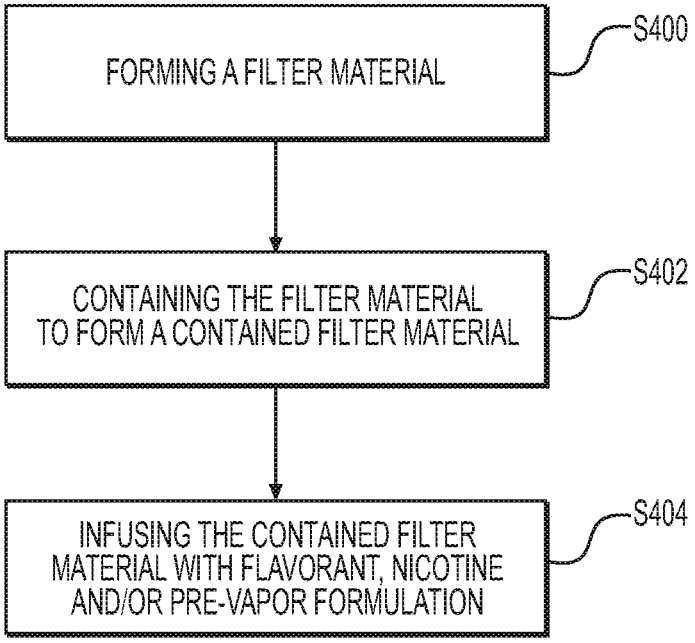
FIG. 8 is a flow chart of a method of making a filter in accordance with an example embodiment.

FIG. 8 is a flow chart of a method of making the filter 104 in accordance with an example embodiment. In step S400, the filter material 105 is formed. As described above, the filter material 105 may be formed from pulp and/or a plant-based cellulose material. In an example embodiment, the filter material 105 is pressed and formed into a flat sheet. In an example embodiment, the filter material 105 is further processed prior to containing the filter material 105 in step S402. In this embodiment, the sheet of the filter material 105 may be crimped to create the crimped filter material 102 (see FIGS. 2B and 2C). In another embodiment, as described above, the filter material 105 is a block of material that includes interstices 101 formed by extrusion, cutting, boring and/or perforating holes or slits through the block of filter material 105.

In step S402, the contained filter material 100 is contained, bound, collected, folded, pressed and/or combined together to form the contained filter material 100 for the filter 104 (as described above). In an example embodiment, the contained filter material 100 is at least partially held together using the containing structure 103. The containing structure 103 may be made from a metal, metal alloy, polymer, plastic, resin, mesh, cellulose, plant-based cellulose, fabric, cotton, fibers, threads, other textiles, pulp, paper, tipping paper, other suitable materials capable of containing the contained filter material 100 together, or combinations, or sub-combinations, of these materials. In an example embodiment, the containing structure 103 is made from sheets or layers of the filter material 105. In an example embodiment, the contained filter material 100 is included in the containing structure 103 of the insert 406/406*b*. In an example embodiment, the containing structure 103 is wrapped in a longitudinal direction around the contained filter material 100 without covering upstream and downstream ends of the contained filter material 100.

In step S404, the filter material 105 is infused with a consumable substance. As described above, in an example embodiment the consumable substance includes the flavorant, nicotine and/or a the pre-vapor formulation. In an example embodiment, the infusing of the flavorant, nicotine and/or pre-vapor formulation occurs as the filter material 105 is being formed, or after the filter material 105 is formed. In another embodiment, the infusing of the flavorant, nicotine and/or pre-vapor formulation occurs as the filter material 105 is being processed into the contained filter material 100, or after the contained filter material 100 is formed. In another embodiment, the contained filter material 100 is infused by the flavorant, nicotine and/or pre-vapor formulation by connecting the reservoir 106 and/or reservoir 20 to the contained filter material 100, where the reservoirs 106/20 may contain the flavorant, nicotine and/or pre-vapor formulation.

Figure 9:
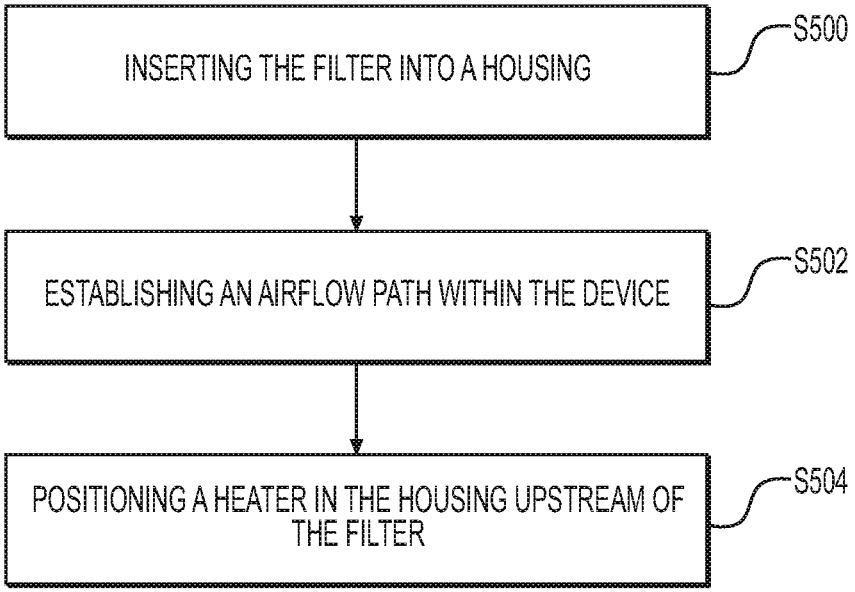
FIG. 9 is a flow chart of a method of making a device including the filter, in accordance with an example embodiment.

FIG. 9 is a flow chart of a method of making the device 60 (or, any of the devices disclosed in the instant example embodiments) including the filter 104, in accordance with an example embodiment. In step S500, the filter 104 and/or contained filter material 100 is inserted into a housing 6*b* of the device 60. In an example embodiment, the filter 104 and/or contained filter material 100 is fitted within the housing 6*b* of the device 60, in step S500, so that gaps do not exist between the sides of the containing structure 103, the filter 104 and/or the contained filter material 100. This causes the vapor 124 within the device 60 to pass through the filter 104 and/or contained filter material 100, rather than being able to circumvent and/or bypass the filter 104 and/or contained filter material 100.

In an example embodiment, prior to step S500, the filter 104 and/or contained filter material 100 is arranged to allow an airflow to traverse through the contained filter material 100. As described above, this may be accomplished by providing openings in the containing structure 103, with an inlet and outlet opening to allow the airflow to pass through the contained filter material 100. In another embodiment, the containing structure 103 is porous, such that the airflow is free to penetrate the containing structure 103 and flow through the contained filter material 100. In another embodiment, the filter 104 does not include the containing structure 103, or the filter 104 only includes the containing structure 103 on sides 100*b* of the contained filter material 100 while ends 100*a* of the contained filter material 100 are open and free of the containing structure 103, thereby allowing airflow to freely enter and pass through the contained filter material 100.

In step S502, an airflow path is established within the device 60. This may be accomplished by adding the one or more air inlets 40 and the mouth-end insert 8 to the device 60, on either side of the filter 104 and/or contained filter material 100, and arranging the internal structure of the device 60 to establish the airflow path. In step S504, a heater 14 is positioned in the airflow path of the device 60, upstream of the filter 104 and/or contained filter material 100. It should be understood that the steps of this method apply equally to a method of making the devices 60/62/64 with the filter 104*a* or the inserts 406/406*b*.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A filter for e-vaping, comprising:

a contained filter material including, one or more portions of a filter material, the one or more portions defining interstices running through a longitudinal length of the contained filter material, the interstices being configured to allow an airflow to pass through the longitudinal length of the contained filter material, and at least one first consumable substance infused within the filter material, the at least one first consumable substance including at least one of nicotine, at least one first flavorant, a pre-vapor formulation, a sub-combination thereof, or a combination thereof, the filter material including more than 98% alpha-cellulose, 0.01% to less than 2% ash and a remainder hemicellulose, the alpha-cellulose being one of a tobacco cellulose or both a non-tobacco plant-based cellulose and the tobacco cellulose.

2. The filter of claim 1, wherein the one or more portions includes at least one sheet of the filter material that is crimped.

3. The filter of claim 1, wherein the one or more portions includes at least one sheet of the filter material that has a plurality of folds, the plurality of folds running through the longitudinal length of the contained filter material, the interstices being defined by the plurality of folds of the at least one sheet of the filter material.

4. The filter of claim 1, wherein the contained filter material has a resistance-to-draw (RTD) of about 5 mm of water to 40 mm of water.

5. The filter of claim 1, wherein the filter material is made from paper, wood pulp, or paper and the wood pulp.

6. The filter of claim 1, wherein the at least one first consumable substance includes the at least one first flavorant, the at least one first flavorant being a tobacco extract.

7. The filter of claim 1, wherein the at least one first consumable substance includes the at least one first flavorant, the at least one first flavorant being a non-tobacco flavorant.

8. The filter of claim 1, wherein the at least one first consumable substance includes nicotine in a weight of between about 1 mg and 15 mg.

9. The filter of claim 1, further comprising:

at least one first containing structure containing the one or more portions, the at least one first containing structure contacting at least side surfaces of the contained filter material, wherein the at least one first containing structure defines a first opening and a second opening on respective ends of the contained filter material.

10. The filter of claim 1, further comprising:

a flow restriction section with a first end and a second end, the first end of the flow restriction section being connected to the contained filter material; and a non-consumable filter connected to the second end of the flow restriction section, the non-consumable filter being devoid of a consumable substance.

11. The filter of claim 10, further comprising:

at least one first containing structure contacting at least side surfaces of the contained filter material, the flow restriction section and the non-consumable filter, to contain the contained filter material, the flow restriction section and the non-consumable filter together, and wherein the flow restriction section defines an internal void space with a flow restrictor in the internal void space, the flow restrictor being spaced apart from the first end and the second end of the flow restriction section.

12. The filter of claim 1, further comprising:

a reservoir containing the at least one first consumable substance, the reservoir being in direct liquid communication with the filter material that is contained within the reservoir.

13. The filter of claim 1, further comprising:

a reservoir configured to contain the at least one first consumable substance; and a structural transport, the structural transport being configured to maintain fluid communication between the reservoir and the contained filter material.

14. A device, comprising:

at least one first section including, an airflow passage, a first reservoir configured to contain at least a first pre-vapor formulation, a heater in communication with the first reservoir and the airflow passage, the heater being configured to at least partially vaporize the first pre-vapor formulation, and a filter in communication with the airflow passage, the filter being downstream of the heater, the filter including, a contained filter material including one or more portions of a filter material, the one or more portions defining interstices running through a longitudinal length of the contained filter material, the interstices being configured to allow an airflow to pass through the longitudinal length of the contained filter material, the filter material including more than 98% alpha-cellulose, 0.01% to less than 2% ash and a remainder hemicellulose, the alpha-cellulose being one of a tobacco cellulose or both a non-tobacco plant-based cellulose and the tobacco cellulose, and at least one first consumable substance infused within the filter material, the at least one first consumable substance including at least one of nicotine, at least one first flavorant, a pre-vapor formulation, a sub-combination thereof, or a combination thereof.

15. The device of claim 14, further comprising:

a control system in electrical communication with the heater, the control system being configured to detect at least one first parameter, the at least one first parameter being at least one of a resistance of the heater, a temperature of the heater, a draw of air in the airflow passage, a combination thereof, or a sub-combination thereof, and the control system being configured to send an electrical current to the heater based on the at least one first parameter.

16. The device of claim 14, wherein the one or more portions includes at least one sheet of the filter material that has a plurality of folds, the plurality of folds running through the longitudinal length of the contained filter material, the interstices being defined by the plurality of folds of the at least one sheet of the filter material.

17. The device of claim 14, wherein the contained filter material has a resistance-to-draw (RTD) of about 5 mm of water to 40 mm of water.

18. The device of claim 14, wherein the at least one first consumable substance includes the at least one first flavorant, the at least one first flavorant being at least one of a tobacco extract, a non-tobacco flavorant or both the tobacco extract and the non-tobacco flavorant.

19. The device of claim 14, wherein the filter further includes, a flow restriction section with a first end and a second end, the first end of the flow restriction section being connected to the contained filter material, the flow restriction section defining an internal void space with a flow restrictor in the internal void space, the flow restrictor being spaced apart from the first end and the second end of the flow restriction section, a non-consumable filter connected to the second end of the flow restriction section, the non-consumable filter being devoid of a consumable substance, and at least one first containing structure contacting at least side surfaces of the contained filter material, the flow restriction section and the non-consumable filter, to contain the contained filter material, the flow restriction section and the non-consumable filter together to form a rod, wherein the rod is configured to insert into a distal end of the at least one first section such that the non-consumable filter extends from the at least one first section.

20. The device of claim 14, further comprising:

a second reservoir containing the at least one first consumable substance, the second reservoir being in direct liquid communication with the filter material that is contained within the second reservoir.

* * * * *